United States Patent [19]

Eheim et al.

[11] 4,409,939

[45] Oct. 18, 1983

[54] FUEL INJECTION PUMP FOR INTERNAL COMBUSTION ENGINES

[75] Inventors: Franz Eheim, Stuttgart; Gerald Höfer, Weissach-Flacht; Helmut Laufer, Stuttgart, all of Fed. Rep. of Germany

[73] Assignee: Robert Bosch GmbH, Stuttgart, Fed. Rep. of Germany

[21] Appl. No.: 232,443

[22] Filed: Feb. 6, 1981

[30] Foreign Application Priority Data

Feb. 7, 1980 [DE] Fed. Rep. of Germany ..... 3004460

[51] Int. Cl.[3] ..... F02M 59/20

[52] U.S. Cl. ..... 123/357; 123/384; 123/447; 123/449

[58] Field of Search ..... 123/446, 447, 448, 449, 123/450, 467, 503, 384, 385, 386, 387, 388, 478, 357

[56] References Cited

U.S. PATENT DOCUMENTS

| | | | |
|---|---|---|---|
| 3,538,897 | 11/1970 | Konrath | 123/387 |
| 3,547,092 | 12/1970 | Knight | 123/447 X |
| 3,557,764 | 1/1971 | Knight et al. | 123/447 |
| 4,069,800 | 1/1978 | Kanda et al. | 123/447 |
| 4,280,464 | 7/1981 | Kanai et al. | 123/478 X |

FOREIGN PATENT DOCUMENTS

| | | | |
|---|---|---|---|
| 54-155319 | 12/1979 | Japan | 123/447 |

*Primary Examiner*—Tony M. Argenbright
*Attorney, Agent, or Firm*—Edwin E. Greigg

[57] ABSTRACT

A fuel injection system is proposed which has a high-pressure pump, a fuel reservoir determining the injection pressure, and an intermediate piston, during whose first half-stroke meters fuel under low pressure and during a second half-stroke, driven by the reservoir, injects the metered fuel. In order to vary the duration of injection, the pressure in the reservoir is determined either by means of the supply quantity of the high-pressure pump or by means of an appropriate pressure control valve in an outflow conduit.

29 Claims, 12 Drawing Figures

FUEL INJECTION PUMP FOR INTERNAL COMBUSTION ENGINES

BACKGROUND OF THE INVENTION

The invention is based on a fuel injection pump of the general type having a main pump piston and an intermediate piston actuated in synchronism with fuel injection. During the intervals between injections, one end of the intermediate piston is exposed to a supply pump, which positively displaces fuel during the upward half of its stroke into a relief conduit. After the reversal of a control apparatus the intermediate piston is exposed on its rear face to the fuel of a high-pressure pump, which supplies the fuel to a fuel injection nozzle. In terms of adapting the principle of injection to engine manufacturers' requirements for optimizing such engine characteristics as fuel consumption, noise, exhaust emissions and the like, a known fuel injection pump of this general type has quite substantial limitations, which are both structurally imposed and caused by variations in temperature.

OBJECT AND SUMMARY OF THE INVENTION

An object of the invention is to regulate the position of a piston in a fuel injection pump as a function of fuel reservoir pressure.

Another object of the invention is to regulate the piston position as a function of crankshaft rotational angle.

A further object of the invention is to regulate the piston in a manner which compensates for temperature and injection nozzle cross section.

The present invention concerns a fuel injection pump having a grooved distributor piston and at least one intermediate piston actuated in synchronism with fuel injection. During the intervals between injections, one end (front face) of the intermediate piston is exposed to the fuel from a low-pressure pump (supply pump), which positively displaces fuel during the first half of its stroke into a relief conduit. After the distributor piston reverses direction, the intermediate piston is exposed on its rear face to the fuel of a high-pressure pump. Thus, the intermediate piston supplies the fuel held in preliminary storage at its front face to a fuel injection nozzle. A fuel reservoir is disposed between the distributor piston work chamber and select distributor piston grooves or the intermediate piston. The working pressure of the fuel reservoir is related to the difference between the fuel quantity delivered by the high-pressure pump and the fuel quantity withdrawn toward the intermediate piston. The fuel reservoir is then uncoupled relative to the pump work chamber via a check valve.

The present invention has the advantage over the prior art that an optimal adaptation of the injection principle to the internal combustion engine is enabled as a result of the variation effected in reservoir pressure. Depending on the specific embodiment of the invention, not only can an optimal adaptation of the duration of injection to the rpm and load be made, taking into particular account the constant cross sections in the injection nozzle as well, but compensation for the effect of temperature on the fuel metering can also be realized. In known fuel injection pumps, the injection quantity decreases as the temperature increases, because the compressibility of the fuel is greater at higher temperatures. It is particularly worthy of mention that, with this fuel injection pump, optimal characteristic values can be attained for Diesel engines at relatively low expense.

The invention will be better understood and further objects and advantages thereof will become more apparent from the ensuing detailed description of several preferred embodiments taken in conjunction with the drawings.

BRIEF DESCRIPTION OF THE DRAWINGS

FIG. 1*a* shows a modification to the pressure line of FIG. 1;

DESCRIPTION OF THE PREFERRED EMBODIMENTS

Figure 1:
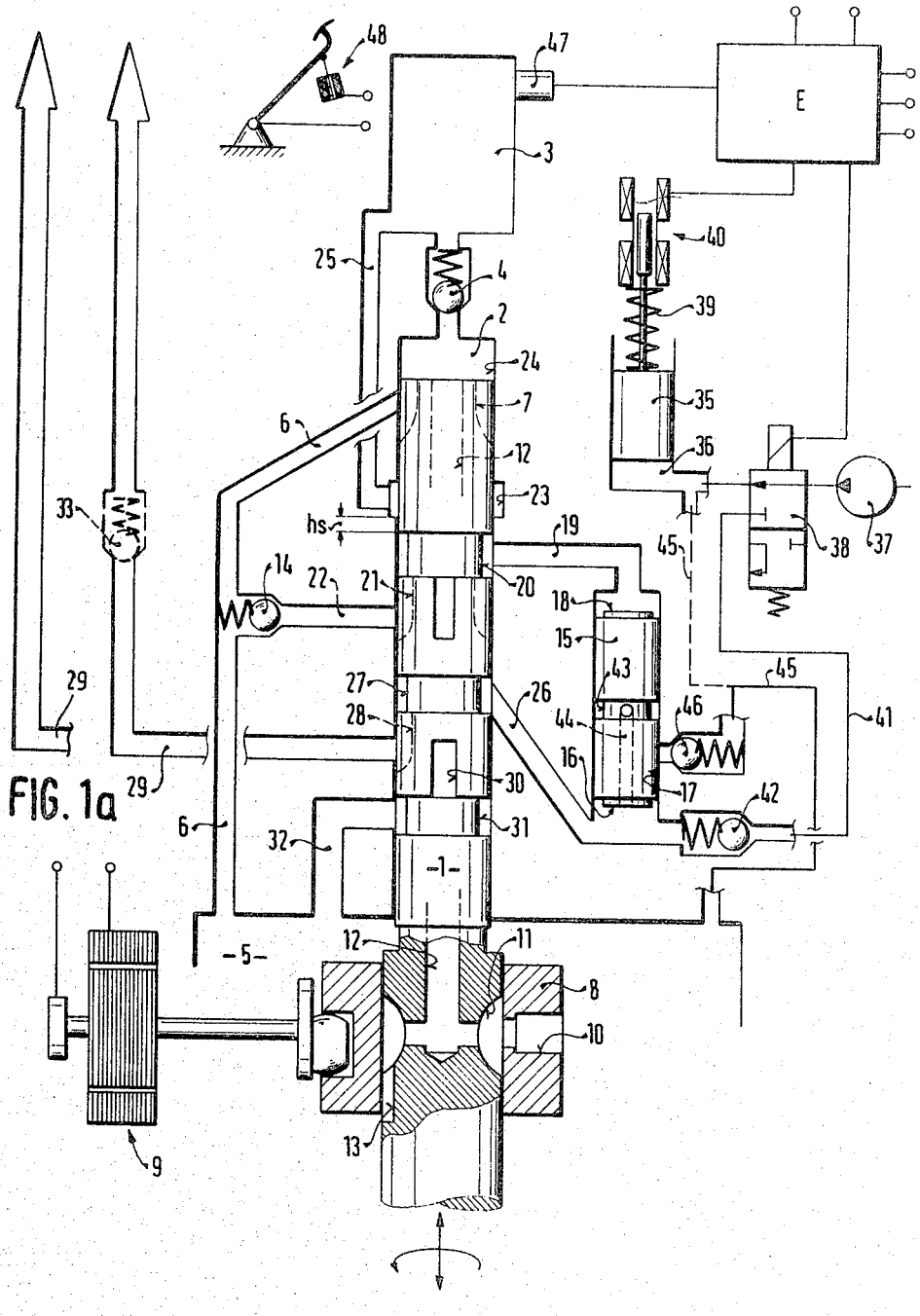
FIG. 1 shows the preferred embodiment of the present invention.
Figure 10:
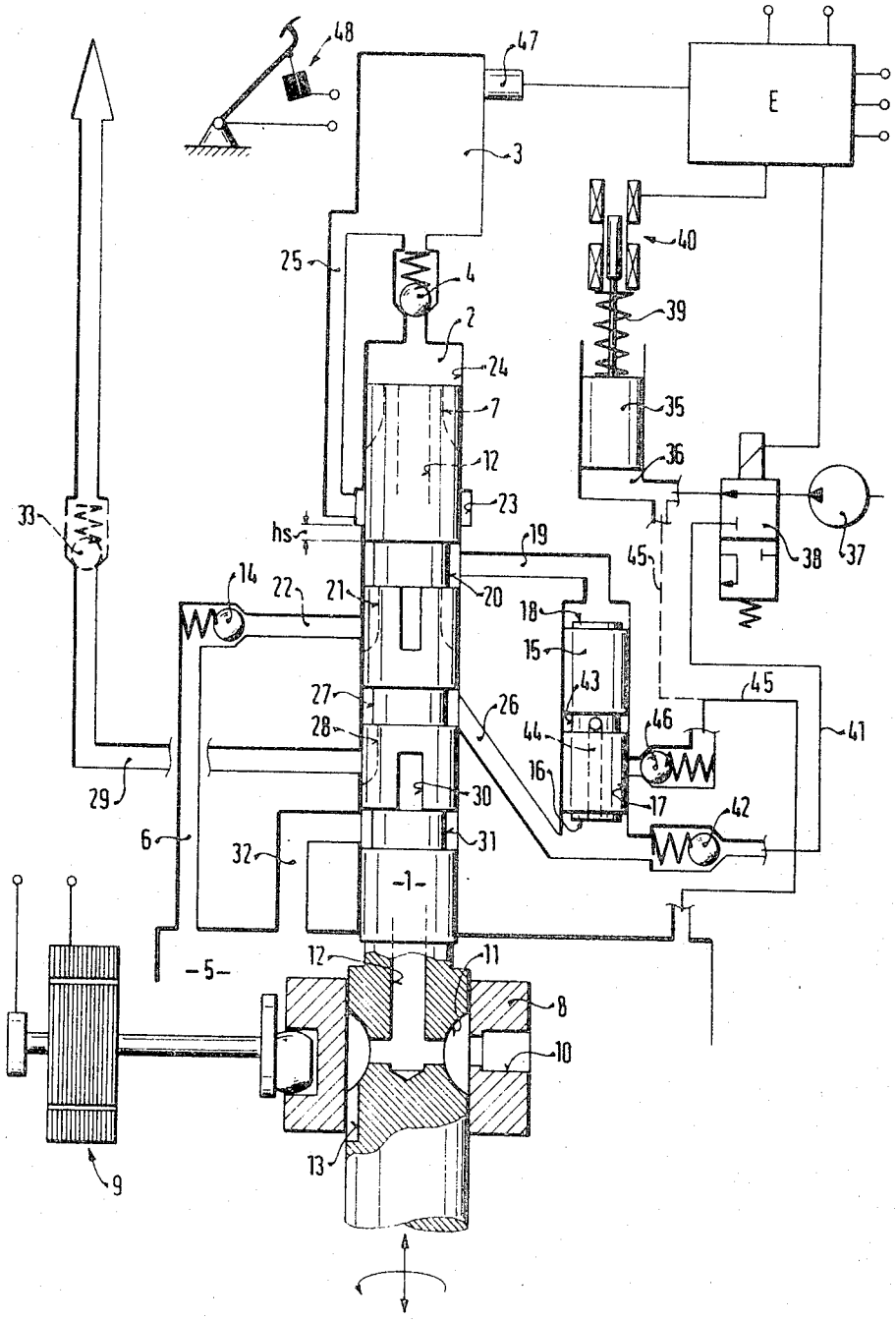
FIG. 10 shows an embodiment of FIG. 1 without an intake conduit.

In FIG. 1, the fundamental layout of the fuel injection system is shown in terms of the first exemplary embodiment. A pump piston 1 is set into simultaneously reciprocal and rotary motion by means not shown and it transports fuel from a pump work chamber 2 into a reservoir 3. Pump piston 1 with work chamber 2 and bore 24 comprise a rotating distributor pump. A check valve 4 is disposed between the pump work chamber 2 and the reservoir 3. The pump work chamber 2 is supplied with fuel out of a suction chamber 5 which is under low pressure. This supply of fuel may be made via an intake conduit 6 and longitudinal grooves 7 disposed in the jacket face of the piston 1 during the intake stroke (downward movement) of the pump piston 1. The supply quantity of this high-pressure pump is controlled by an annular slide 8, which is displaceable on the pump piston 1 by an electric servomotor 9 and which, with radial bores 10 in the annular slide 8, controls longitudinal grooves 11 which communiate with the pump work chamber 2 via a central longitudinal bore 12. The supply onset is determined via a longitudinal groove 13 communicating with one of the grooves 11, the longitudinal groove 13 dipping into the annular slide in so doing. However, as an alternative to the example described above the pump work chamber 2 can also be supplied with fuel from the suction chamber 5 via these bores 10 in the annular slide 8 during the intake stroke of the pump piston 1 by means of opening the longitudinal grooves 11 and the central longitudinal bore 12. See FIG. 10. Accordingly, on the compression stroke of pump piston 1, a variably large quantity of fuel is delivered from the pump work chamber 2 into the reservoir 3. Also, fuel is withdrawn from the reservoir 3. The pressure in this reservoir 3 at any time is therefore dependent upon the variable quantity originally delivered from the pump work chamber 2.

The fuel metering is effected in this fuel injection system by way of an intermediate piston 15, below the supply side or front face 16 of which fuel is supplied into a cylinder 17, the intermediate piston 15 is displaced upward in its first half-stroke which positively displaces fuel with its rear face 18. This positively displaced fuel passes via a line 19 into an annular groove 20 of the pump piston 1 and from there flows via one of a plurality of longitudinal grooves 21 into a relief conduit 22, which communicates via a check valve 14 with the intake conduit 6.

For injection to occur, after the stroke $h_s$ has been executed through the annular groove 20 and after the longitudinal groove 21 has been separated from the relief conduit 22, an annular groove 23 is opened, this annular groove 23 being disposed in the wall of the cylinder bore 24 receiving the pump piston 1 and communicating via a pressure conduit 25 with the reservoir 3. After this groove 23 has been opened, the fuel, which is under variable pressure, flows out of the reservoir 3 via the annular grooves 23, 20 into the line 19 and from there reaches the rear face 18 of the intermediate piston 15. The intermediate piston 15 is thereby displaced downward in its second half-stroke and with its front face 16, it positively displaces fuel out of the cylinder 17 via a pressure conduit 26 into an annular groove 27 disposed in the pump piston 1 and from there flows via a longitudinal distributor groove 28 into a pressure line 29, which leads to a fuel injection nozzle disposed on the internal combustion engine. The pressure lines 29 branching off from the cylinder bore 24 correspond in number to the number of cylinders of the engine which are to be supplied with fuel. Thus, the various grooves 20, 21, 23 act to control fluid flow within the distributor (pump piston 1 with cylinder bore 24).

After the injection is terminated, which occurs parallel with the compression stroke of the pump piston 1, the annular groove 27 and the pressure conduit 26 are separated by means of the longitudinal groove 28 from the pressure line 29. Upon further rotation of the pump piston 1, the pressure line 29 is then relieved of pressure toward the pump suction chamber 5 by means of a longitudinal groove 30, which communicates via an annular groove 31 with a relief conduit 32. As indicated by broken lines, a pressure relief valve 33 may be disposed if needed in the pressure line 29. Effecting the relief of pressure in this manner is not, however, absolutely necessary, and the pressure line 29 may be embodied as shown in FIG. 1*a*.

The metering of fuel into the cylinder 17 is effected, in this first exemplary embodiment, via a metering piston 35, whose metering chamber 36 is supplied with fuel by a supply pump 37 with an interposed magnetic valve 38. In the illustrated position of the 3/2-way valve 38, fuel flows into the metering chamber 36 and displaces the piston 35 counter to the force of a supply spring 39. The stroke of the metering piston 35 thus effecting is measured by a transducer 40, whose measurement value is fed into an electronic control device E. Depending upon the intended supply quantity, the magnetic valve 38 is then switches in position once an appropriate filling of the metering chamber 36 has been effected, after which the inflow from the supply pump 37 is blocked and the metering chamber 36 is connected via a metering line 41, in which a check valve 42 is disposed, with the cylinder 17 of the intermediate piston 15. If at this instant an injection is taking place, so that fuel is being supplied from the cylinder 17, then the metering piston 35 remains in its outset position until such time as this injection procedure is terminated and the relief conduit 22 relieves the pressure at the rear face 18 of the intermediate piston 15 via one of the longitudinal grooves 21. The metering piston 35 is thereafter displaced by the spring 39, which positively displaces the metered fuel into the cylinder 17, and a further injection procedure can now begin. The flow of fuel back into the metering conduit 41 is prevented by the check valve 42. In order that the intermediate piston 15 will not strike against its stop with excessive force toward the end of injection, an annular groove 43 is disposed in its jacket face, leading via a longitudinal blind bore 44 to the front face 15. This annular groove 43, toward the end of the injection stroke of the intermediate piston 15, opens a relief bore 45 in the pump housing, a check valve 46 being disposed in this relief bore 45. As indicated by broken lines, it is alternatively possible for this relief bore 45 to discharge into the metering chamber 36 instead of into the suction chamber 5. The metered fuel injection quantity is determined by the electronic control device E, whose computer is supplied with values for the pressure in the reservoir 3 via a transducer 47, the load of the vehicle via a gas pedal transducer 48, and the rpm and other engine characteristics via other transducers, not shown. The injection quantity or injection duration is then determined by the electronic control device E via electrical-to-mechanical converters such as the magnetic valve 38 and the servomotor 9. The duration of injection is preferably particularly long at relatively low rpm (that is, during idling and partial load), so as to reduce noise. The variable compressibility is compensated for in accordance with temperature by making a correction in the metered quantity. With the relatively simple structure described above, this fuel injection system enables an optimum adaptation of the fuel metering and fuel preparation on the one hand to the engine and the environment on the other.

Figure 2:
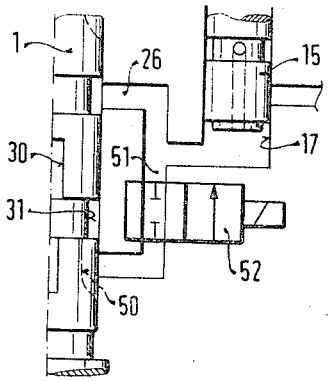
FIG. 2 shows a second embodiment which utilizes an electro-magnetic valve.

In the second exemplary embodiment shown in FIG. 2, as in the case of all the following embodiments as well, elements which are unchanged are given identical reference numerals. Elements which are altered but which have the same function are given the same reference numerals but with a prime added.

Figure 11:
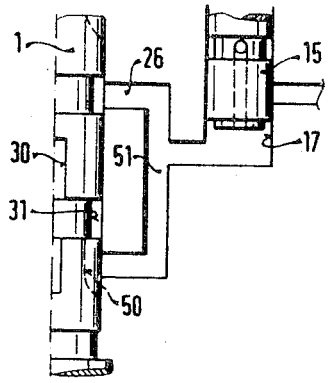
FIG. 11 shows an embodiment of FIG. 2.

In this second exemplary embodiment, longitudinal grooves 50 branch off from the annular groove 31 on the side remote from that longitudinal groove 30 (that is, on the bottom); the number of longitudinal grooves 50 corresponds to the number of injection strokes to be performed per rotation of the pump piston 1. Thus, as may be understood with the aid of FIG. 1 as well, these longitudinal grooves 50 always communicate with the pump suction chamber 5. They control a supply conduit 51, which discharges into the pressure conduit 26 and thus into the cylinder 17 of the intermediate piston 15. The longitudinal grooves 50 establish this fluid communication solely at those times when there is not communication between the rear face 18 of the intermediate piston 15 and the reservoir 3. In order to determine the quantity of quantity of fuel to be injected and which is to be received by cylinder 17, it is possible either to limit the stroke of the intermediate piston 15 on its rear face by controlling the passage through the supply line 51 in a time dependent manner by means of a magnetic valve as indicated in FIG. 2. In principle, this embodiment functions similarly to the first embodiment described above except for the fuel metering. An embodiment not having a magnetic valve, FIG. 11, may be controlled in the manner described in the discussion of FIG. 4.

Figure 3:
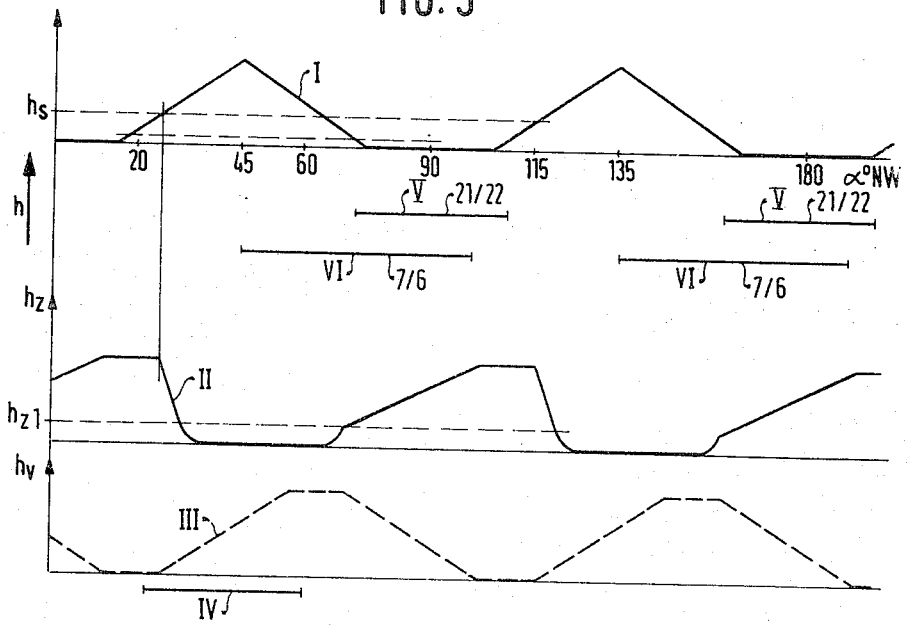
FIG. 3 shows the stroke of the pistons in FIG. 1 as a function of crankshaft angle.

FIG. 3 is a function diagram for the fuel injection system shown in FIG. 1. The stroke h is plotted on the ordinate over the rotary angle $\alpha$ in degrees of the camshaft NW on the abscissa. These strokes are labeled I for that of the pump piston 1, II for the intermediate piston 15, and III for the metering piston 35. Beginning at the middle between two drive cams of the pump piston 1, the compression stroke of the pump piston 1 begins after it has rotated by $\alpha=20°$ NW. After a further 6 or 7 degrees, the pump piston 1 has executed the stroke $h_s$, after which the annular grooves 20 and 23 begin to overlap one another. If at this point one observes the course of the intermediate piston II, then the very steep downward stroke of the intermediate piston 15 begins here. As soon as a remaining stroke $h_{z1}$ has been attained during this return course, the relief bore 45 is opened by the annular groove 43, so that a damping of the intermediate piston 15 is initiated. However, as long as the intermediate piston 15 assumes its upper position (that is, before injection begins), the metering piston 35 is displaced as indicated by curve III for the purpose of filling up the cylinder 36. The magnetic valve 38 assumes the position shown in FIG. 1, in which the supply pump 37 communicates with the metering chamber 36. At the angle $\alpha=45°$, as may be seen from curve I, the pump piston 1 has attained its highest point, while the intermediate piston 15 rests on its stop. However, the filling procedure for the metering chamber 36 has not yet been completed. This occurs at $\alpha=60°$, after which the magnetic valve 38 switches over into the switching position (opposite of that shown in FIG. 1); to this end, the fuel flows out of the metering chamber 36 into the cylinder 17 below the end face 16 of the intermediate piston 15. As may be seen from curve II, the stroke $h_z$ of the intermediate piston 15 now increases once again. In order for the intermediate piston 15 to be able to execute its appropriate upward stroke, the line 19 is relieved of pressure via one of the longitudinal grooves 21 and via the relief conduit 22 in the rotational range between $\alpha=70°$ and $\alpha=110°$. This is indicated by line V in the diagram. In contrast, line VI indicates the relative length of time (that is, between $\alpha=45°$ and $\alpha=$approx. 90°) that one of the longitudinal grooves 7 overlaps the intake conduit 6, so that there is communication between the pump work chamber 2 and the suction chamber 5. At $\alpha=105°$, the magnetic valve 38 is switched over, so that after a brief delay the stroke $h_v$ of the metering piston 35 can begin once again, for which purpose the magnetic valve assumes its position of FIG. 1. At $\alpha=115°$, the pump piston has again executed the stroke $h_s$ in accordance with curve I and has established the high-pressure connection between the grooves 20 and 23; accordingly, as may be seen from curve II, the steep downward stroke of the piston 15 which effects the injection begins. As described above, the filling of the cylinder 36 is already taking place in parallel therewith, for the purpose of fuel metering. At $\alpha=120°$, the damping of the intermediate piston 15 already begins. At $\alpha=160°$, the upward stroke of the intermediate piston 15 then begins again, as shown by curve II, and subsequently, as shown by curve III, the magnetic valve 38 is switched back into its position opposite that shown in FIG. 1. These control procedures are repeated as many times per rotation as there are cylinders of the engine to be supplied with fuel. As may be understood, the injection here takes place solely over a range of $\alpha=5°$. If it should be necessary to prolong or to shorten the duration of injection, then the downward edge of curve II can be made to have a flatter or a steeper course by varying the pressure in the reservoir 3.

Figure 4:
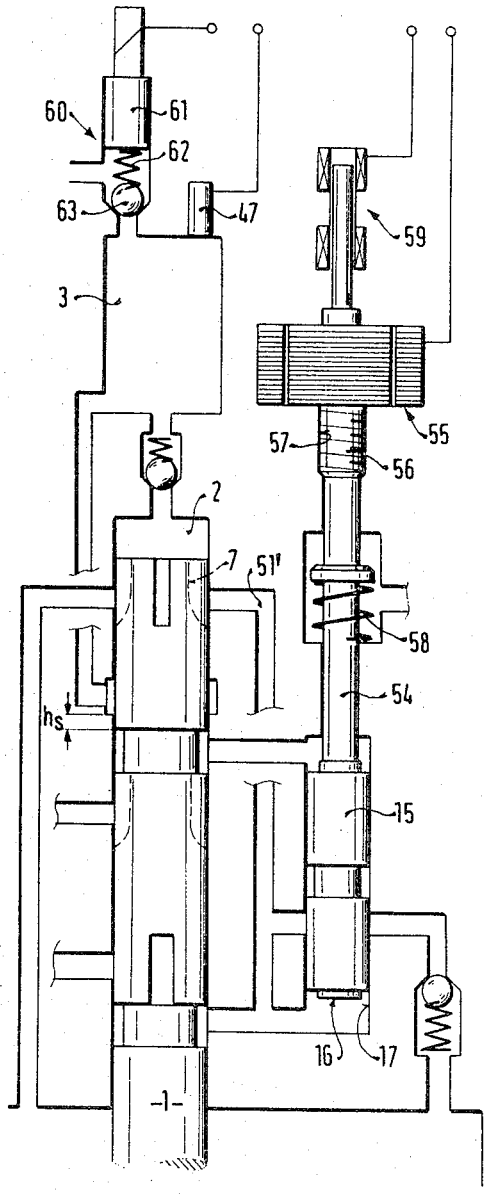
FIG. 4 shows a third means to regulate the position of the intermediate piston.

In FIG. 4, the third exemplary embodiment is shown, in which the stroke of the intermediate piston 15 is limited by a stop 54. This stop is adjustable via a servomotor 55, the end 56 remote from the intermediate piston 15 having a thread which engages a counterpart thread 57 disposed in the housing. When the servomotor 55 rotates, the stop 54 is thereby displaced axially, a spring 58 serving to assure that the outset position is free of play. The axial displacement of the stop 54 is detected by a transducer 59. The high-pressure control is effected in the same manner as in the first two exemplary embodiments. The preliminary storage of fuel, however, is made into the cylinder 17 below the front face 16 of the intermediate piston 15 and is directed out of the pump work chamber 2 by one of the grooves 7, the communication being established by a supply conduit 51'. However, it is also possible for the supply of fuel to be effected as shown in connection with the second exemplary embodiment.

Figure 5:
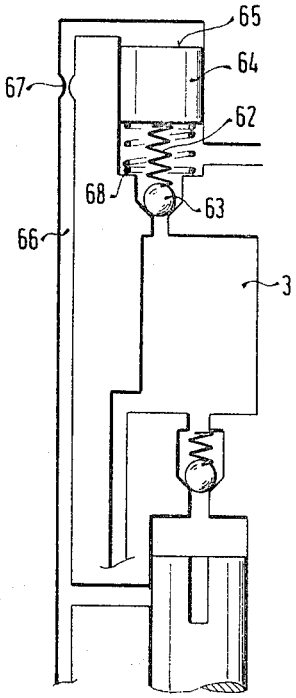
FIG. 5 shows another embodiment of the pressure regulator of FIG. 4.

In contrast to the first exemplary embodiment, the pressure in the reservoir 3 is regulated in this variant embodiment, as well as in that shown in FIG. 5, by a pressure regulator 60. In the variant shown in FIG. 4, a magnetic control element 61 varies the initial stress of a spring 62 of a pressure maintenance valve 63. As a result, the pressure in the reservoir 3, measured by the transducer 47, is controllable directly. In the variant shown in FIG. 5 for this exemplary embodiment, the variation of the initial stress of the spring 62 of the pressure maintenance valve 63 is effected via a hydraulic piston 64, whose rear face 65 is exposed to a fluid whose pressure is dependent on rpm. This pressure is withdrawn in an advantageous manner from the suction chamber 5 of the pump via a line 66. A throttle 67 may be provided for the purpose of damping. As needed, a compensation spring 68 may be used in parallel to the spring 62, or the pressure in the spring chamber may also be controlled by appropriate means.

Figure 6:
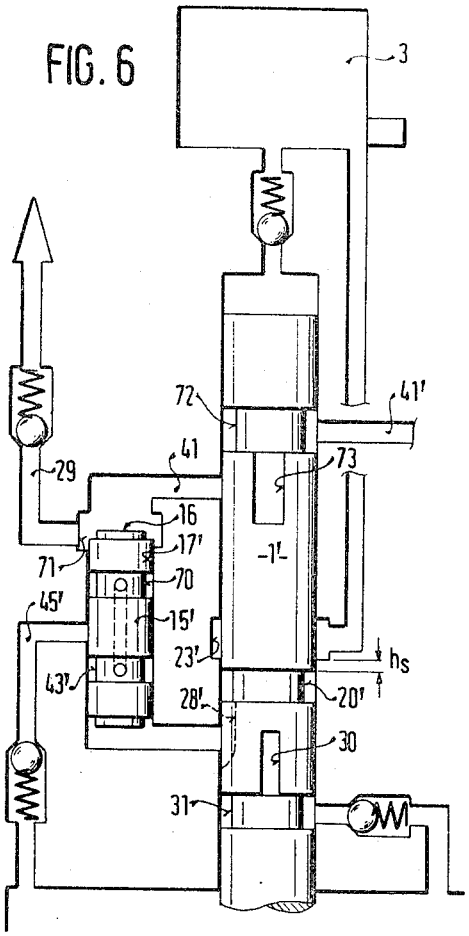
FIG. 6 shows a fourth embodiment of the present invention.

In the fourth exemplary embodiment shown in FIG. 6, the regulation of the pressure in the reservoir 3 as well as the fuel supply to this reservoir 3 are effected as in the first exemplary embodiment. However, deviating therefrom, the intermediate piston 15' of the fourth exemplary embodiment is provided with two annular grooves, the first of which, 43', likewise cooperates with the relief conduit 45', but the second annular groove, 70, is capable of being opened directly toward the pressure line 29 by way of an annular groove 71. As a result, first a damping of the intermediate piston 15' toward the end of its injection stroke is attained and second a relief of the pressure line 29 at the end of injection is attained. In contrast to the other exemplary embodiments, the intermediate piston 15' in this embodiment moves upward in performing its injection stroke. Also, the longitudinal distributor groove 28' branches off from the annular groove 20', which in turn cooperates with the annular groove 23'. The preliminary storage of fuel into the cylinder 17' ahead of the front face 16 of the intermediate piston 15' is effected via a metering conduit 41', which is controlled, however, by means of a distributor piston 1' via an annular groove 72 and a longitudinal groove 73. The metering of fuel may be accomplished in one of the ways described above.

Figure 7:
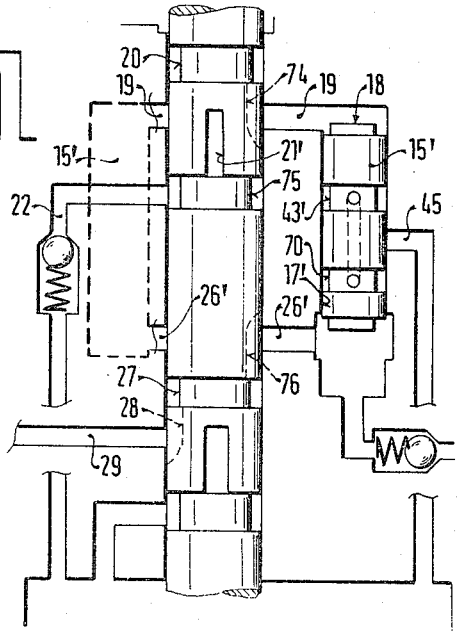
FIG. 7 depicts another embodiment of the device of FIG. 6 having two intermediate pistons.

In FIG. 7, a variant of the first exemplary embodiment is shown, in which two intermediate pistons are used in place of one intermediate piston 15. As a result, it is possible accordingly to obtain time for the preliminary storage of fuel into the cylinders 17' of those two intermediate pistons 15'. The intermediate pistons 15' are equipped, as in the fourth exemplary embodiment, with two annular grooves 43' and 70, with damping being effected after the annular groove 70 opens up toward the cylinder 17' and the annular groove 43' opens toward the relief conduit 45. The opening up of the respective lines 19 leading to the rear face 18 of the intermediate piston 15' must be effected in this instance via a longitudinal groove 74 which discharges into the annular groove 20. The relief of the line 19, which must be done during the intervals between injection so that fuel can be placed in preliminary storage, is effected via longitudinal grooves 21' which discharge into an annular groove 75, which communicates in turn with the relief conduit 22. In order to obtain the alternating association of the pressure conduits 26' of the two cylinders 17' with the longitudinal distributor groove 28, two longitudinal grooves 76, only one of which is shown, are provided between the annular groove 27 and the pressure conduits 26'.

Figure 8:
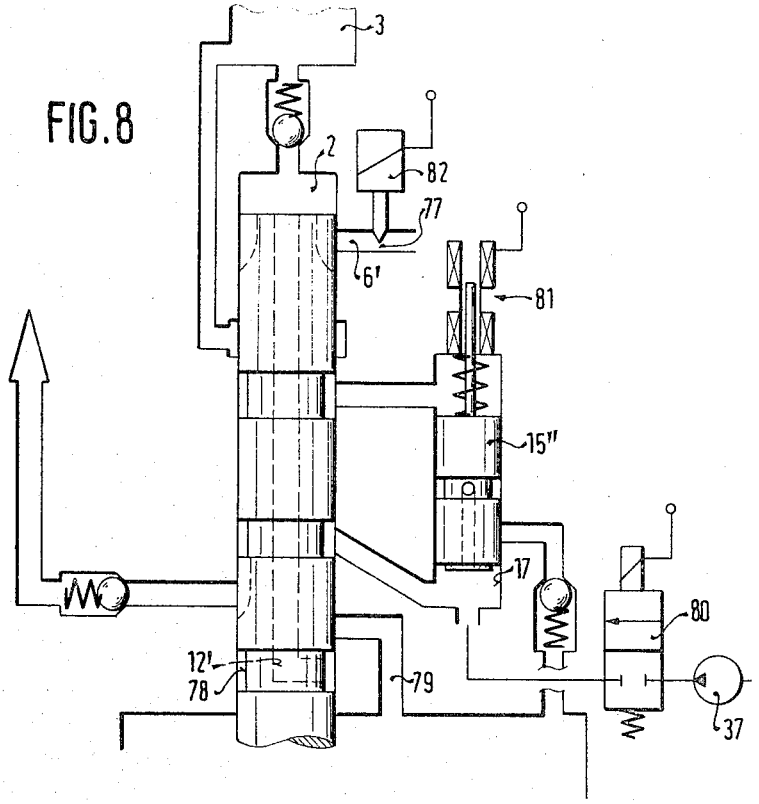
FIG. 8 shows a fifth embodiment which utilizes a fuel intake throttle.

In the fifth exemplary embodiment shown in FIG. 8, the supply output of the high-pressure pump is determined by an intake throttle 77 which is disposed in the intake line 6'. The end of injection is generated by an annular groove 78, which communicates via a central longitudinal bore 12' with the pump work chamber 2 and which, after a predetermined stroke has been executed, opens up a relief bore 79 extending within the housing. The cylinder 17 of the intermediate piston 15'' is supplied directly with fuel by the supply pump 37, with a 2/2-way valve 80 being interposed. The stroke of the intermediate piston 15'' is measured by a transducer 81 connected therewith. This exemplary embodiment functions in principle like those discussed above, the cross section of the intake throttle 77 being advantageously variable via an electric servomotor 82.

Figure 9:
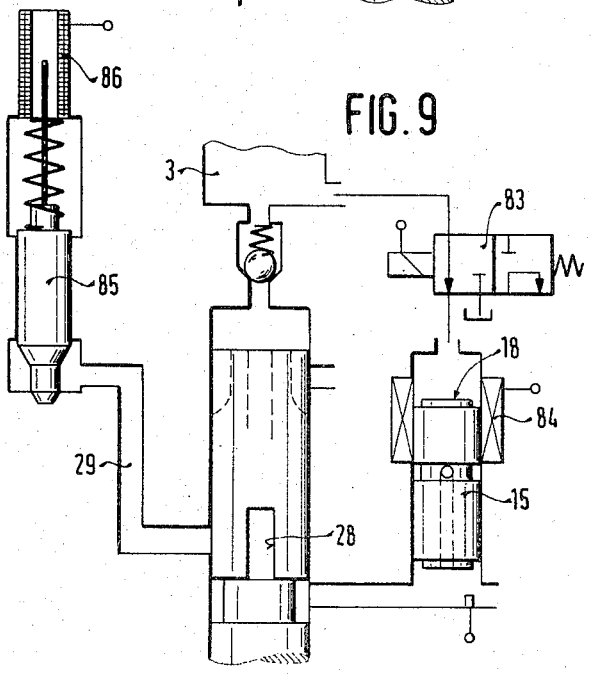
FIG. 9 shows a sixth embodiment which utilizes a 3/2 valve to control the stroke of the intermediate piston.

In the sixth and last exemplary embodiment shown in FIG. 9, the drive of the intermediate piston 15 is effected not via the distributor piston 1 but rather via a 3/2-way valve 83, which in the illustrated position connects the reservoir 3 with the rear face 18 of the intermediate piston 15 so that injection can take place. A travel transducer 84 is disposed surrounding the piston 15, and as a result the switchover of the 3/2-way valve 83 is effected after a stroke of appropriate length has been executed. It is conceivable in this respect that the switchover of the magnetic valve 83 may be effected whenever in the course of the injection stroke the appropriate injection quantity has been injected, or whenever, in the other position of the magnetic valve 83, the preliminary storage stroke is to be terminated. In the first instance a transducer 86 must be provided at the injection nozzle 85, and in the second instance the injection onset must be determined via the distributor groove 28.

In the individual exemplary embodiments, various control possibilities are shown; these possibilities may also be applicable in different combinations, so long as these combinations fulfill the requirements of the invention.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In a fuel injection system, having a fuel injection nozzle for internal combustion engines including:

a fuel supply an intermediate piston having a front face and a rear face, which is actuated back and forth synchronously to the cycles of the fuel injections and which front face in fluidly connectable to an injection line of said fuel nozzle;

a low pressure supply pump which is connected to supply fuel to the injection system;

control means for timely connecting the fuel supply to the front face of said intermediate piston initiating its backmovement;

a high pressure pump having a work chamber which forces fuel into a fuel reservoir, said control means controlling the fuel quantity forced into said fuel reservoir and further controlling the period of a fluid connection between the fuel reservoir and the rear face of the intermediate piston thereby initiating the forth moving and the injection stroke of the intermediate piston;

a relief conduit fluidly connecting the rear face of the intermediate piston stroke on its backmovement to the low pressure supply pump;

said fuel reservoir receiving fuel from the work chamber when the high pressure pump is in a compression stroke, such that the pressure of the reservoir is related to the difference between the fuel quantity received from the work chamber and the fuel quantity withdrawn to the rear face on the forward movement of the intermediate piston and a check valve located between the reservoir and the work chamber to fluidly disconnect the reservoir and the work chamber when the high pressure pump is in an intake stroke.

2. In a fuel injection system as described in claim 1, wherein the high pressure pump is comprised as a rotating distributor pump having a pump piston, and wherein the control means is comprised as a first plurality of grooves in the pump piston surface.

3. In a fuel injection system as described in claim 1, wherein the control means is comprised as an electromagnetic valve.

4. In a fuel injection system as described in claim 2, wherein the distributor pump has a rotating pump piston which serves to pump fuel in the injection system.

5. In a fuel injection system as described in claim 1, the system further including an electrical control means connected to control reservoir pressure.

6. In a fuel injection system as described in claim 1, the system further including an electrical control means connected to regulate the quantity of fuel injected from the injection nozzle.

7. In a fuel injection system as described in claim 2, wherein the pump piston has a second plurality of grooves which control the flow of fuel between the front face and the injection nozzle.

8. In a fuel injection system as described in claim 2, wherein the fuel flow between the front face and the low pressure supply pump is regulated by the pump piston.

9. In a fuel injection system as described in claim 2, the system further including an electrically actuated valve to regulate the fuel flow between the front face and the low pressure supply system.

10. In a fuel injection system as described in claim 9, the system including a fuel line fluidly connecting the electrically actuated valve and the intermediate piston, and including a further check valve disposed such that fuel in the fuel line only flows from the electrically actuated valve to the intermediate piston.

11. In a fuel injection system as described in claim 9, the system further including a metering piston which is fluidly connected to the electrically actuated valve such that when the electrically actuated valve is in a first state the metering piston is fluidly connected to the low pressure supply pump, and when the electrically actuated valve is in a second state the metering piston is fluidly connected to the front face.

12. In a fuel injection system as described in claim 11, wherein the electrically actuated valve is electromagnetic.

13. In a fuel injection system as described in claim 11, the system further including an inductive transducer connected to detect the metering piston position, and to generate a signal indicative thereof to the electrical means such that the electrical means regulates quantity of fuel injection according to the transducer signal.

14. In a fuel injection system as described in claim 13, the system further including:

a relief conduit connected to the intermediate piston;

a pressure line which connects the high pressure pump to the intermediate piston, wherein on the second half of the intermediate piston stroke the relief conduit is opened to relieve the pressure line.

15. In a fuel injection system as described in claim 14, the system further including a metering chamber which receives the metering piston and is connected to the relief conduit to receive the fuel relieved by the pressure line.

16. In a fuel injection system as described in claim 2, the system further including a flow pressure chamber which is connected to the distributor pump and to the rear face via the relief conduit such that the chamber is opened, to receive fuel during the intervals between fuel injections, by the distributor pump.

17. In a fuel injection system as described in claim 3, the system further including a lower pressure chamber which is connected to the electromagnetic valve and to the rear face via the relief conduit such that the chamber is opened, to receive fuel during the intervals between injections, by the electromagnetic valve.

18. In a fuel injection system as described in claim 1, the system further including a positionally variable stop which is connected such that the position of the stop regulates the stroke of the intermediate piston.

19. In a fuel injection system as described in claim 18, the system further including an electrical drive means connected to the variable stop to vary the position of the stop.

20. In a fuel injection system as described in claim 19, wherein the electrical drive means is a stepping motor.

21. In a fuel injection system as described in claim 19, wherein the stepping motor has an armature connected to the variable stop which controls the position of the variable stop.

22. In a fuel injection system as described in claim 20, wherein the stepping motor has an armature connectd to the variable stop which controls the position of the variable stop.

23. In a fuel injection system as described in claim 1, the system further including an intake throttle disposed in a fuel line connecting the fuel supply and the pump work chamber to regulate the fuel quantity flowing to the high pressure pump.

24. In a fuel injection system as described in claim 23, the system further including an electrical device connected to the intake throttle to control the intake throttle cross section.

25. In a fuel injection system as described in claim 23, the system further including an opening conduit which is connected to the pump work chamber such that the opening conduit opens to release fuel from the pump work chamber at the end of the high pressure pump compression stroke.

26. In a fuel injection system as described in claim 24, the system further including an opening conduit which is connected to the pump work chamber such that the opening conduit opens to release fuel from the pump work chamber at the end of the high pressure pump compression stroke.

27. In a fuel injection system as described in claim 2, the system further including:

an annular slide disposed about the pump piston to regulate pump piston movement;

a filling conduit which is connected to the pump work chamber to supply fuel to the pump work chamber, wherein the annular slide is positioned to control fuel flow into the filling conduit such that the fuel quantity in the high pressure pump is regulated.

28. In a fuel injection system as described in claim 27, the system further including an electrically operated apparatus connected to the annular slide to adjust the annular slide position.

29. In a fuel injection system as described in claim 5, the system further including:

a plurality of transducers to detect characteristics of the fuel injection system and the internal combustion engine which are connected to the electrical control means to send a signal to the electrical control means indicating system and engine characteristics;

a plurality of electrical-to-mechanical converters connected to the electrical control means which operate in response to the system and engine characteristics.

* * * * *